US008045867B2

(12) United States Patent
Park

(10) Patent No.: US 8,045,867 B2
(45) Date of Patent: Oct. 25, 2011

(54) APPARATUS AND METHOD TO SUPPLY DEVELOPER

(75) Inventor: Jong-hyun Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 792 days.

(21) Appl. No.: 11/949,813

(22) Filed: Dec. 4, 2007

(65) Prior Publication Data

US 2008/0285985 A1 Nov. 20, 2008

(30) Foreign Application Priority Data

May 14, 2007 (KR) ..... 10-2007-0046638

(51) Int. Cl.
*G03G 15/06* (2006.01)
*G03G 15/00* (2006.01)

(52) U.S. Cl. ..... 399/44; 399/97

(58) Field of Classification Search ..... 399/44, 399/97, 58

See application file for complete search history.

(56) References Cited

U.S. PATENT DOCUMENTS

| | | | | |
|---|---|---|---|---|
| 4,314,755 | A * | 2/1982 | Kinashi | 399/44 |
| 5,125,357 | A * | 6/1992 | Honma et al. | 118/621 |
| 7,403,727 | B2 * | 7/2008 | Fujimori et al. | 399/49 |
| 7,650,100 | B2 * | 1/2010 | Murata et al. | 399/253 |
| 2004/0091275 | A1 * | 5/2004 | Matsuda et al. | 399/27 |
| 2007/0177888 | A1 * | 8/2007 | Ishida | 399/27 |

* cited by examiner

*Primary Examiner* — David Porta
*Assistant Examiner* — Yara Green
(74) *Attorney, Agent, or Firm* — Stanzione & Kim, LLP

(57) ABSTRACT

Embodiments of an image forming apparatus, developer supplying apparatus and methods thereof may control a developer conveying speed in accordance with image print conditions, environmental status and/or developer amount to substantially maintain a stable amount or supply amount of developer. The developer may include bi-component developer having toner and carrier.

25 Claims, 5 Drawing Sheets

APPARATUS AND METHOD TO SUPPLY DEVELOPER

CROSS-REFERENCE TO RELATED APPLICATIONS

This application claims priority under 35 U.S.C. §119(a) of Korean Patent Application No. 10-2007-0046638, filed on May 14, 2007, in the Korean Intellectual Property Office, the disclosure of which is hereby incorporated herein in its entirety by reference.

BACKGROUND OF THE INVENTION

1. Field of the Invention

The present general inventive concept relates to an apparatus and a method to supply developer, and more particularly, to an apparatus and a method to evenly supply developer, which can control an operation speed or rotation speed of a conveying member that conveys the developer.

2. Description of the Related Art

A conventional electrophotographic developer process visualizes an electrostatic latent image and transfers the visualized image onto a printing medium. Such developer process generally uses a uni-component developer, which uses toner only, or bi-component developer, which uses carrier and toner in certain proportions.

It is important for a bi-component developer type of image forming apparatus to accurately control proportions of toner and carrier, that is, to control toner density at a stable proportion, in order to obtain a high-quality image. This can be done by setting a reference toner density that is based on the toner density detected by a sensing member from a predetermined area during a replacement of a developer.

However, toner density may vary because of surrounding conditions such as temperature or humidity, which can change toner fluidity. For example, toner flows relatively faster in low temperature, thus increasing flow rate of developer. Toner flows relatively slower in high temperature, thus decreasing a reference and flow rate. Even under the same temperature, the toner fluidity varies according to the degree of humidity. Therefore, toner fluidity is slower in high temperature and high humidity, than in high temperature and low humidity. Because a reference is decreased under high temperature and high humidity, image quality degrades. Because toner fluidity changes according to the surrounding factors such as temperature or humidity, toner density cannot be maintained as it is initially set, and this can decrease image quality.

SUMMARY OF THE INVENTION

The present general inventive concept provides apparatuses and methods that can increase uniformity of supplied developer.

The present general inventive concept provides exemplary apparatuses and methods to supply developer that can control conveyance of developer based on the environmental conditions to improve developer supply uniformity.

The present general inventive concept also provides embodiments of an apparatus and a method for supplying developer that can adjust rotational speed of developer conveying member based on a detected signal regarding the amount of developer to improve a uniformity of developer.

Additional aspects and/or utilities of the present general inventive concept will be set forth in part in the description that follows and, in part, will be obvious from the description, or may be learned by practice of the present general inventive concept.

The foregoing and/or other aspects and/or utilities of the present general inventive concept may be achieved by providing a developer supplying apparatus that includes a first sensing member to detect environmental status, a developer conveying member to convey a developer by rotational movement, a first setting unit to set rotational speed of the developer conveying member according to the detected environmental status and a control unit to perform a first control of rotational speed of the developer conveying member according to the rotational speed set by the first setting unit.

The environmental status may include an internal temperature of the developer supplying apparatus, and the first setting unit may set the rotational speed of the developer conveying member to a default value if the temperature detected by the first sensing member falls into a range between a first threshold temperature and a second threshold temperature.

The first setting unit may set the rotational speed of the developer conveying member to be slower than the default value if the first sensing member detects the temperature below the first threshold temperature, and may set the rotational speed of the developer conveying member to be faster than the default value if the first sensing member detects the temperature exceeding the second threshold temperature.

The environmental status may include internal humidity of the developer supplying apparatus, and the first setting unit may set the rotational speed of the developer conveying member to a default value if the first sensing member detects the humidity that falls into a range between a first threshold humidity and a second threshold humidity.

The first setting unit may set the rotational speed of the developer conveying member to be slower than the default value if the first sensing member detects the humidity below the first threshold humidity, and may set the rotational speed of the developer conveying member to be faster than the default value if the first sensing member detects the humidity exceeding the second threshold humidity.

The environmental status may include categories of low temperature and low humidity, normal status, and high temperature and high humidity according to internal temperature and humidity of the developer supplying apparatus, and the first setting unit may set the rotational speed of the developer conveying member to be slower than the default value if the first sensing member detects the environmental status to be the low temperature and low humidity, may set the rotational speed of the developer conveying member to the default value if the first sensing member detects the environmental status to be the normal status, and may set the rotational speed of the developer conveying member to be faster than the default value if the first sensing member detects the environmental status to be the high temperature and high humidity.

The developer supplying apparatus may further include a second sensing member to detect the amount of developer and generate a detection signal and a second setting unit to set the rotational speed of the developer conveying member by comparing the detection signal of the second sensing member with a reference range. The control unit may perform a second control of rotational speed of the developer conveying member according to the rotational speed set by the second setting unit.

The second setting unit may maintain a predetermined rotational speed if the detection signal falls into the reference range.

The second setting unit may set the rotational speed of the developer conveying member to be slower than the predetermined rotational speed if the detection signal is below a lower boundary of the reference range, and may set the rotational speed of the developer conveying member to be faster than the predetermined rotational speed if the detection signal exceeds an upper boundary of the reference range.

If the second control of the rotational speed of the developer conveying member is performed, the control unit may control the second sensing member and the second setting unit to re-detect the amount of developer and to re-set the rotational speed according to the result of re-detection, and may re-control the rotational speed of the developer conveying member to the re-set rotational speed.

The developer may include bi-component developer including toner and carrier.

The foregoing and/or other aspects and/or utilities of the present general inventive concept may be achieved by providing a method of supplying developer that includes detecting environmental status, setting rotational speed of a developer conveying member according to the detected environmental status, and performing a first control of rotational speed of the developer conveying member according to the set rotational speed.

The environmental status may include an internal temperature of the developer supplying apparatus, and the setting may include setting the rotational speed of the developer conveying member to a default value if the detected temperature falls into a range between a first threshold temperature and a second threshold temperature.

The setting may include setting rotational speed of the developer conveying member to be slower than the default value if the detected temperature is below the first threshold temperature, and setting rotational speed of the developer conveying member to be faster than the default value if the detected temperature exceeds the second threshold temperature.

The environmental status may include internal humidity of the developer supplying apparatus, and the setting may include setting the rotational speed of the developer conveying member to a default value if the detected humidity falls into a range between a first threshold humidity and a second threshold humidity.

The setting may include setting the rotational speed of the developer conveying member to be slower than the default value if the detected humidity is below the first threshold humidity, and setting the rotational speed of the developer conveying member to be faster than the default value if the detected humidity exceeds the second threshold humidity.

The environmental status may include categories of low temperature and low humidity, normal status, and high temperature and high humidity according to internal temperature and humidity of the developer supplying apparatus. The setting may include setting the rotational speed of the developer conveying member to be slower than the default value if the detected environmental status is the low temperature and low humidity, setting the rotational speed of the developer conveying member to the default value if the detected environmental status is the normal status, and setting the rotational speed of the developer conveying member to be faster than the default value if the detected environmental status is the high temperature and high humidity.

The method may further include detecting the amount of developer and generating a detection signal, setting the rotational speed of the developer conveying member by comparing the detection signal with a reference range, and performing a second control of the rotational speed of the developer conveying member according to the set rotational speed.

The setting rotational speed of the developer conveying member by comparing the detection signal with the reference range may include maintaining a predetermined rotational speed if the detection signal falls into the reference range.

The setting rotational speed of the developer conveying member by comparing the detection signal with the reference range may include setting the rotational speed of the developer conveying member to be slower than the predetermined rotational speed if the detection signal is below a lower boundary of the reference range, and setting the rotational speed of the developer conveying member to be faster than the predetermined rotational speed if the detection signal exceeds an upper boundary of the reference range.

If the second control of the rotational speed of the developer conveying member is performed, the method may further include re-detecting the amount of developer and re-setting the rotational speed according to a result of the re-detection, and controlling the rotational speed of the developer conveying member to the re-set rotational speed.

The foregoing and/or other aspects and/or utilities of the present general inventive concept may be achieved by providing a developer supplying apparatus including a developing conveying member to convey a developer by rotational movement, and to adjust the rotational movement to adjust an amount of the developer according to environmental status.

The foregoing and/or other aspects and/or utilities of the present general inventive concept may be achieved by providing an image forming apparatus including a printing unit to forming an image on a printing medium, and a developer supplying apparatus to communicate with the printing unit, and having a developing conveying member to convey a developer by rotational movement, and to adjust the rotational movement to adjust an amount of the developer according to environmental status.

BRIEF DESCRIPTION OF THE DRAWINGS

These and/or other aspects and/or utilities of the present general inventive concept will become apparent and more readily appreciated from the following description of the embodiments, taken in conjunction with the accompanying drawings of which.

DETAILED DESCRIPTION OF EMBODIMENTS

Figure 1:
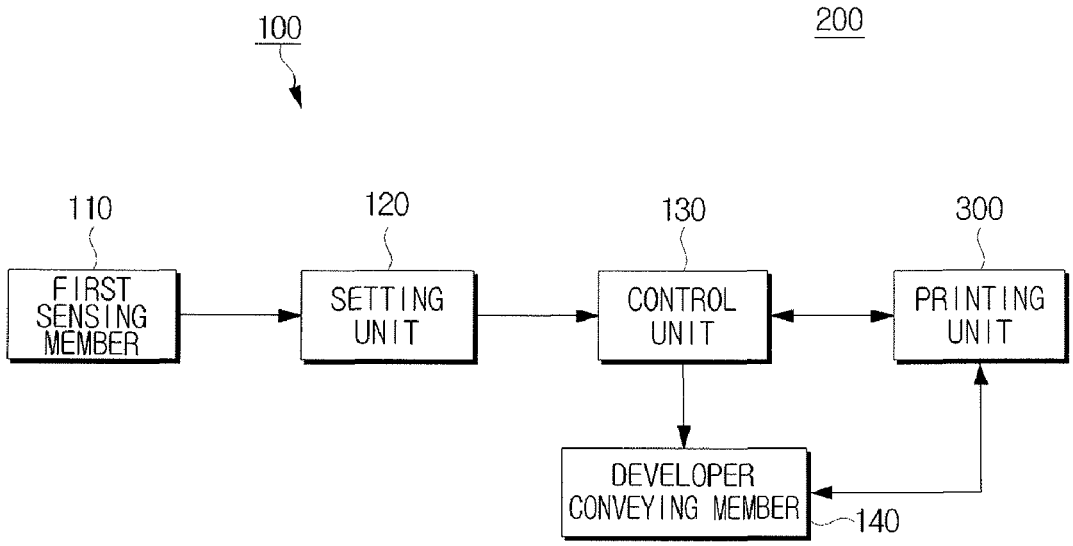
FIG. 1 is a block diagram illustrating a developer supplying apparatus according to an exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram of a developer supplying apparatus usable with an image forming apparatus 200 according to an exemplary embodiment of the present general inventive concept. As illustrated in FIG. 1, the developer supplying apparatus includes a first sensing member 110, a first setting unit 120, a control unit 130 and a developer conveying member 140. The image forming apparatus 200 may include a printing medium feeding unit to pick-up and feed a printing medium, a printing unit 300 to form or print an image on the printing medium, and a discharge unit to discharge the printing medium. The developer supplying apparatus 100 of FIG. 1 can be installed in the image forming apparatus to communicate with the printing unit 300.

The first sensing member 110 detects environmental status of the developer supplying apparatus 100. The environmental status may include any environmental factors that can influence fluidity of developer such as temperature, humidity or the like. The environmental status may include environmental factors inside or outside the developer supplying apparatus, and inside or outside an image forming apparatus which includes the developer or the like that can influence the developer. The developer may have fast, high or increased fluidity in an environment of high temperature or high humidity, and may have slow, low or reduced fluidity in an environment of low temperature or low humidity. The first sensing member 110 may implement one of temperature sensing member and a humidity sensing member to detect temperature or humidity. The first sensing member 110 may implement a thermo-hygrometer to detect temperature and humidity. The first sensing member 110 may be positioned on one area of the path along which the developer is conveyed. However, embodiments of the present general inventive concept is not intended to be limited by such an exemplary disclosure, for example, the first sensor may be coupled inside/outside a corresponding image forming apparatus.

The first setting unit 120 may set an operation speed (e.g., a rotational speed) of the developer conveying member 140 according to the environmental status detected by a sensor (e.g., the first sensing member 110). If the first sensing member 110 senses that the environmental status includes low temperature or low humidity, the first setting unit 120 sets rotational speed of the developer conveying member 140 to be slower than a default value to take relatively fast fluidity of developer into consideration. If the first sensing member 110 senses that the environmental status includes high temperature or high humidity, the first setting unit 120 sets rotational speed of the developer conveying member 140 to be faster than a default value to take relatively slow fluidity of developer into consideration.

For example, if temperature detected through the first sensing member 110 belongs to a first threshold temperature or a second threshold temperature (e.g., is in a range between the first threshold temperature and the second threshold temperature), the first setting unit 120 sets rotational speed of the developer conveying member 140 to a default value. Default value may be based on reference toner density, image print speed, an image forming apparatus characteristics or the like. If temperature detected through the first sensing member 110 does not meet the first threshold temperature, the first setting unit 120 determines the detected temperature to be low. If temperature detected through the first sensing member 110 exceeds the second threshold temperature, the first setting unit 120 determines the detected temperature to be high. The first setting unit 120 may set the rotational speed of the developer conveying member 140 accordingly. Examples of the first threshold temperature may be 17° C., and the second threshold temperature may be 30° C. However, the above example is not intended to limit the present general inventive concept, for example, the first and second threshold temperatures may be varied in accordance with the environment where the developer supplying apparatus 100 is placed.

In an alternative example, the first setting unit 120 sets rotational speed of the developer conveying member 140 to a default value if humidity detected through the first sensing member 110 belongs to a first threshold humidity or a second threshold humidity (e.g., is in a range between the first threshold humidity and the second threshold humidity). If humidity detected through the first sensing member 110 does not meet the first threshold humidity, the first setting unit 120 determines the detected humidity to be low. If humidity detected through the first sensing member 110 exceeds the second threshold humidity, the first setting unit 120 determines the detected humidity to be high. The first setting unit 120 sets rotational speed of the developer conveying member 140 accordingly. Examples of the first threshold humidity may be 45%, and the second threshold humidity may be 65%. However, such examples are not limiting. The first and second threshold humidity may also be varied in accordance with the environment where the developer supplying apparatus 100 is placed.

The environmental status may be categorized in various combinations such as into low temperature and low humidity, normal status, high temperature and high humidity or the like, according to detections such as temperature and humidity by the first sensing member 110. The first setting part 120 may set rotational speed of the developer conveying member 140 according to the environmental status. For example, the first setting unit 120 sets rotational speed of the developer conveying member 140 to a default value when the environmental status is detected to be normal (e.g., a default detection). The first setting unit 120 may set the rotational speed of the developer conveying member 140 to be slower than a default value if the environmental status is detected to be low temperature and low humidity. The first setting unit 120 may set the rotational speed of the developer conveying member 140 to be faster than a default value, if the environmental status is detected to be high temperature and high humidity. The environmental status may be further specified in combinations of detected environmental status such as temperature and humidity, including for example, low temperature and low humidity, low temperature and high humidity, high temperature and low humidity, and high temperature and high humidity.

The developer conveying member 140 may implement a configuration such as a screw structure or the like in which developer is input through one side and output through the other side for developer processing. However, embodiments are not intended to be limited thereto. When the screw structure of the developer conveying member 140 rotates, the developer flows from one to the other side and is discharged. The operational speed of the developer conveying member can be adjusted based on the fluidity of the developer. In the screw structure case, the developer conveying member 140 can adjust to the fluidity of the developer using the rotational speed. The rotational speed of the developer conveying member 140 may be controlled by revolution-per-minute (RPM).

The control unit 130 may control the overall operation of the developer supplying apparatus. For example, if the first setting unit 120 sets rotational speed of the developer conveying member 140, the control unit 130 controls rotational speed of the developer conveying member 140 such as RPM based on the set value. Accordingly, the amount of the supplied developer can be maintained stable by use of the rotational speed of the developer conveying member 140 adaptively controlled to the environmental status.

Figure 2:
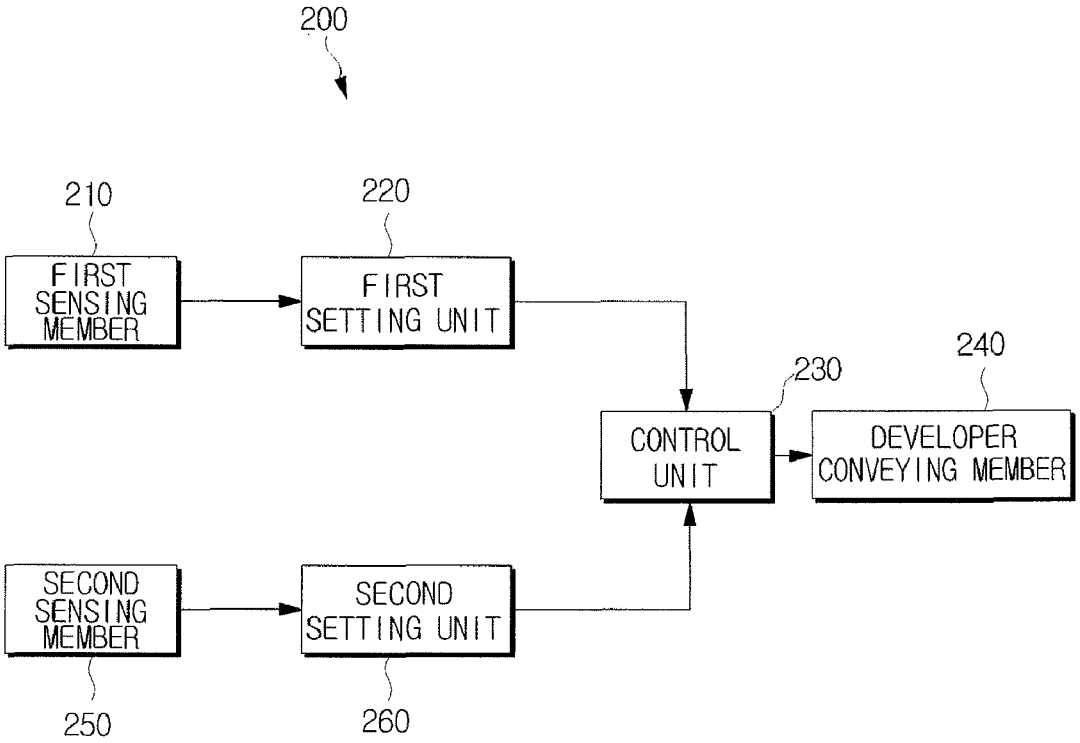
FIG. 2 is a block diagram illustrating a developer supplying apparatus according to another exemplary embodiment of the present general inventive concept.

FIG. 2 is a block diagram of a developer supplying apparatus according to another exemplary embodiment of the present general inventive concept. As illustrated in FIG. 2, the developer supplying apparatus 200 includes a first sensing member 210, a first setting unit 220, a control unit 230, a developer conveying member 240, a second sensing member 250 and a second setting unit 260. The developer supplying apparatus of FIG. 2 will now be explained, however, the like elements or operations overlapping those explained above with reference to FIG. 1 will be described briefly for the sake of brevity.

The first sensing member 210 detects environmental status around the developer supplying apparatus 200. The environmental status includes factors such as temperature or humidity, which can influence the fluidity of the developer.

The first setting unit 220 sets rotational speed of the developer conveying member according to the environmental status detected through the first sensing member 210. For example, the first setting unit 220 sets rotational speed of the developer conveying member 240 according to the detected result of the first sensing member 210, which may include temperature or humidity or combinations thereof such as high temperature and high humidity or low temperature and low humidity.

The developer conveying member 240 may implement a screw structure. The developer conveying member 240 adjust to fluidity of the developer using rotational speed.

Toner density may be controlled by detecting an amount of developer via a sensing member provided at one area of a toner conveyance path. The sensing member detects changes in toner density at a predetermined area, and accordingly adjusts toner supply. If the detected amount of developer does not reach the initially-set reference, the sensing member may determine that carrier is lacking even when the developer is insufficient due to lack of toner. In this case, toner is not supplied any more. Accordingly, balance between toner and carrier is broken and toner density may become unstable. As a result, a printed page or medium may have a degraded image quality. If such a toner density imbalance continues, the lifespan of the developer, which is consumable, shortens, and a user has to purchase a new developer. Furthermore, carrier may be used instead of toner when the toner is lacking, which will cause shortening or may shorten a lifespan of the image fixing apparatus or image forming apparatus.

The second sensing member 250 preferably generates a detection signal regarding the amount of developer. The detection signal may be an electric signal, and used to control toner supply. For example and more specifically, the second sensing member 250 may detect the amount of carrier and determine the remaining amount to be the toner amount. If the amount of developer is less than an initially-set reference, the second sensing member 250 detects that the carrier is lacking, and that the toner is in larger amount. Therefore, the second sensing member 250 decreases the detection signal. In a case where the second sensing member 250 keeps decreasing the detection signal, the detection signal does not meet a reference range. If the detection signal is below the lower boundary of the reference range and does not meet the reference range, the toner is not supplied, however, it may be the toner that is lacking. As a result, image forming process is not performed appropriately, and the currently-mounted toner cartridge cannot be used. Therefore, it is important that the amount of developer is controlled before the detection signal falls below the lower boundary of the reference range.

If more than usual amount of toner is consumed for special purpose such as a high-density image, the second sensing member 250 may increase the detection signal to compensate for this sudden large consumption of toner. The detection signal may keep increasing and exceed the upper boundary of the reference range. If the detection signal is above the upper boundary of the reference range and does not meet the reference range, supply of a large amount of toner may cause overflow. Therefore, it is important or necessary that the amount of the developer is controlled before the detection signal exceeds the upper boundary of the reference range. The reference range may be set to be narrower than the voltage range, which is possibly generated based on the amount of developer detected through the second sensing member 250.

The second setting unit 260 preferably re-sets rotational speed of the developer conveying member 240 according to the detection signal generated by the second sensing member 250. For example, the second setting unit 260 may maintain the preset rotational speed, if the detection signal generated by the second sensing member 250 belongs to the reference range. If the detection signal is below the lower boundary of the reference range, the second setting unit 260 sets the rotational speed of the developer conveying member 240 to be slower than the preset rotational speed. If the detection signal generated by the second sensing member 250 exceeds the upper boundary of the reference range, the second setting unit 260 sets the rotational speed of the developer conveying member 240 to be faster than the preset rotational speed. The preset rotational speed may be the rotational speed that is set during the first control of rotational speed of the developer conveying member 240.

The control unit 230 may control the overall operation of the developer supplying apparatus 200. For example, the control unit 230 first or primarily can control the rotational speed of the developer conveying member 240, if the first setting unit 220 sets rotational speed of the developer conveying member 240.

If the second setting unit 260 sets rotational speed of the developer conveying member 240, the control unit 230 may control (e.g., secondarily) the rotational speed of the developer conveying member 240 accordingly. Developer is accumulated, and therefore, more developer is detected by the second sensing member 250 when the rotational speed of the developer conveying member 240 is controlled to be slower than a predetermined rotational speed. If the rotational speed of the developer conveying member 240 is controlled to be faster than the current rotational speed, the amount of the developer being discharged increases compared to the input, and therefore, the second sensing member 250 detects less amount of developer. By appropriately controlling the rotational speed of the developer conveying member 240 based on above embodiments (e.g., using the control unit 230), the amount of developer being conveyed can be stably controlled.

The control unit 230 preferably controls rotational speed of the developer conveying member 240 until a detection signal being generated by the second sensing member 250 falls into the reference range. The control signal 230 may control (e.g., repeatedly) the second sensing member 250 to generate a detection signal by re-detecting the amount of developer a predetermined time after secondarily controlling rotational speed of the developer conveying member 240. If the second setting unit 260 re-sets rotational speed of the developer conveying member 240, the control unit 230 can then control the rotational speed of the developer conveying member 240 according to the re-set rotational speed. By detecting the environmental status and amount of developer and adjusting rotational speed of the developer conveying member 240 accordingly, the control unit 230 is able to stably control the amount of developer being supplied.

The first and second setting units 220, 260 may set a variety of rotational speeds according to output speeds or configurations of a developer conveying member such as an outer screw diameter, configuration or pitches of the developer conveying member 240. The rotational speed of the developer conveying member 240 can also be set differently according to the speed at which an image is output.

Figure 3:
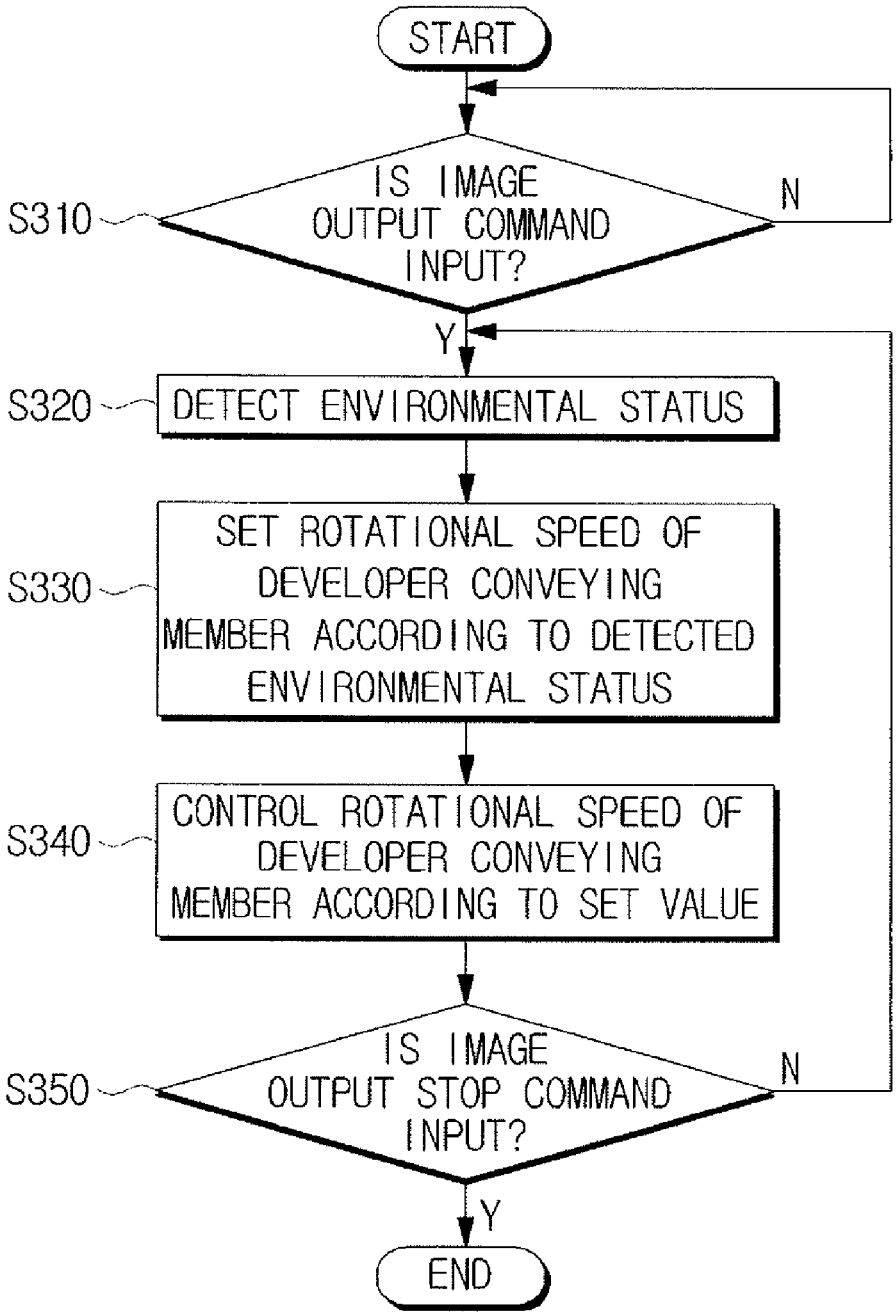
FIG. 3 is a flowchart illustrating a method for supplying developer according to an exemplary embodiment of the present general inventive concept.

FIG. 3 is a flowchart illustrating a method of supplying developer according to an exemplary embodiment of the present general inventive concept. The method embodiment of FIG. 3 will be described using the embodiment of FIG. 1, however, the method embodiment of FIG. 3 or the present general inventive concept is not intended to be limited thereby.

As illustrated in FIG. 3, when the developer supplying apparatus 100 receives an image output command at operation S310, the developer supplying apparatus 100 can then detect environmental status using the first sensing member 110 at operation S320. When the developer supplying apparatus 100 receives a command that is not the image output command at operation S310, the method can wait for the next input command (e.g., control jumps back to operation S310). The environmental status may include any environmental factors that can influence fluidity of developer, such as (but not limited to) temperature or humidity. The first sensing member 110 may implement one each of temperature sensing member and a humidity sensing member to respectively detect temperature or humidity, or a thermohygrometer to detect temperature and humidity.

At operation S330, the developer supplying apparatus 100 may set a rotational speed of the developer conveying member 140 according to the environmental status detected through the first sensing member 110. The developer supplying apparatus 100 preferably sets rotational speed of the developer conveying member 140 to be slower than a default value, if the first sensing member 110 detects low temperature or low humidity. The developer supplying apparatus 100 preferably sets rotational speed of the developer conveying member 140 to be faster than a default value, if the first sensing member 110 detects high temperature or high humidity.

After the rotational speed of the developer conveying member 140 is set according to the environmental status, the developer supplying apparatus 100 at operation S340 controls the rotational speed according to the set value. Then upon receiving an image output stop command at operation S350, the developer supplying apparatus 100 stops the controlling of the rotational speed of the developer conveying member 140. As a result, rotational speed of the developer conveying member 140 is controlled according to the environmental status around the developer supplying apparatus 100, and fluidity of developer is maintained stably. When the image output stop command is not received at operation S350, repetition of the S320, S330 and S340 operations may be performed.

Figure 4:
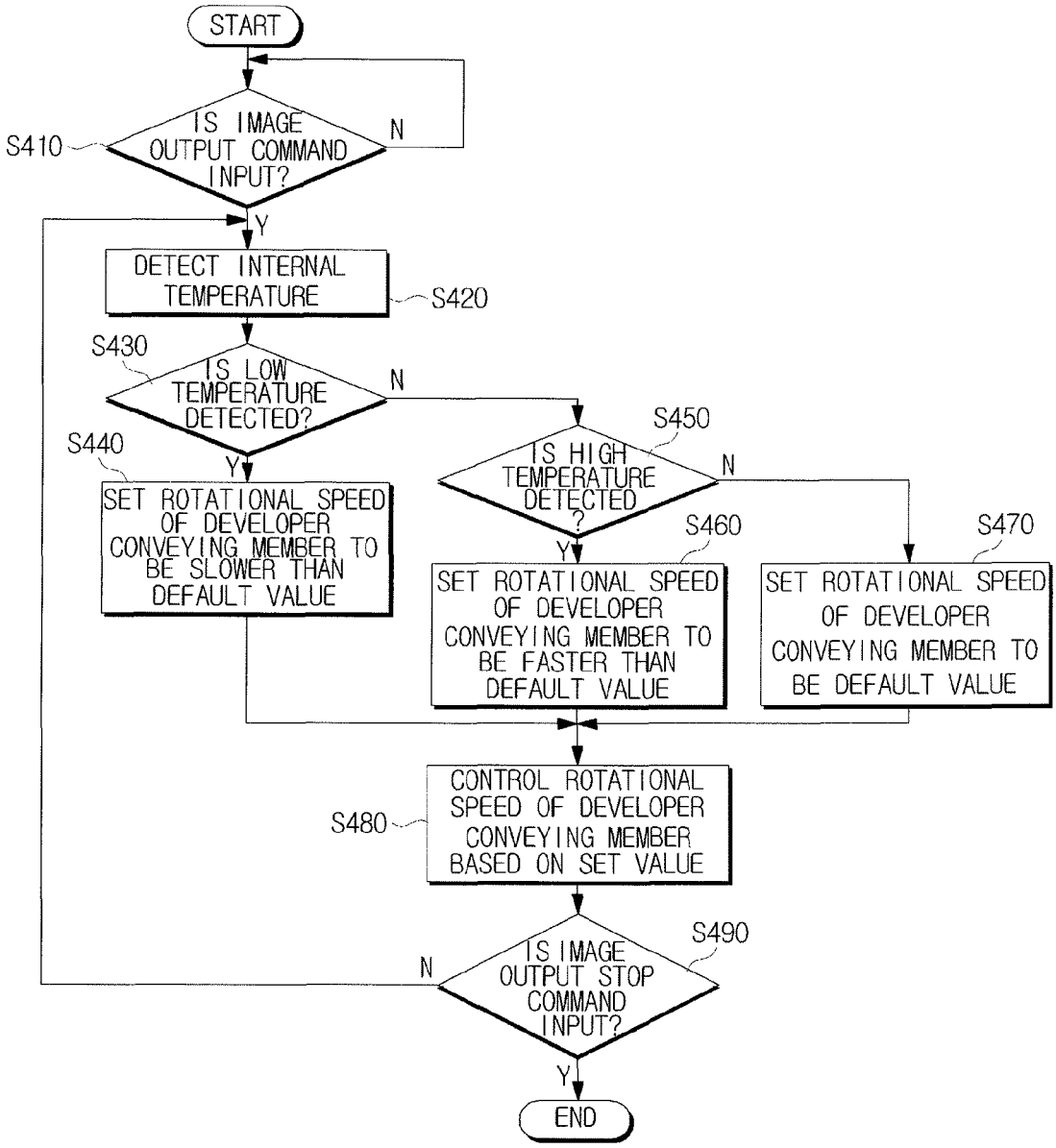
FIGS. 4 and 5 are flowcharts illustrating a method for supplying developer according to another exemplary embodiment of the present general inventive concept.
Figure 5:
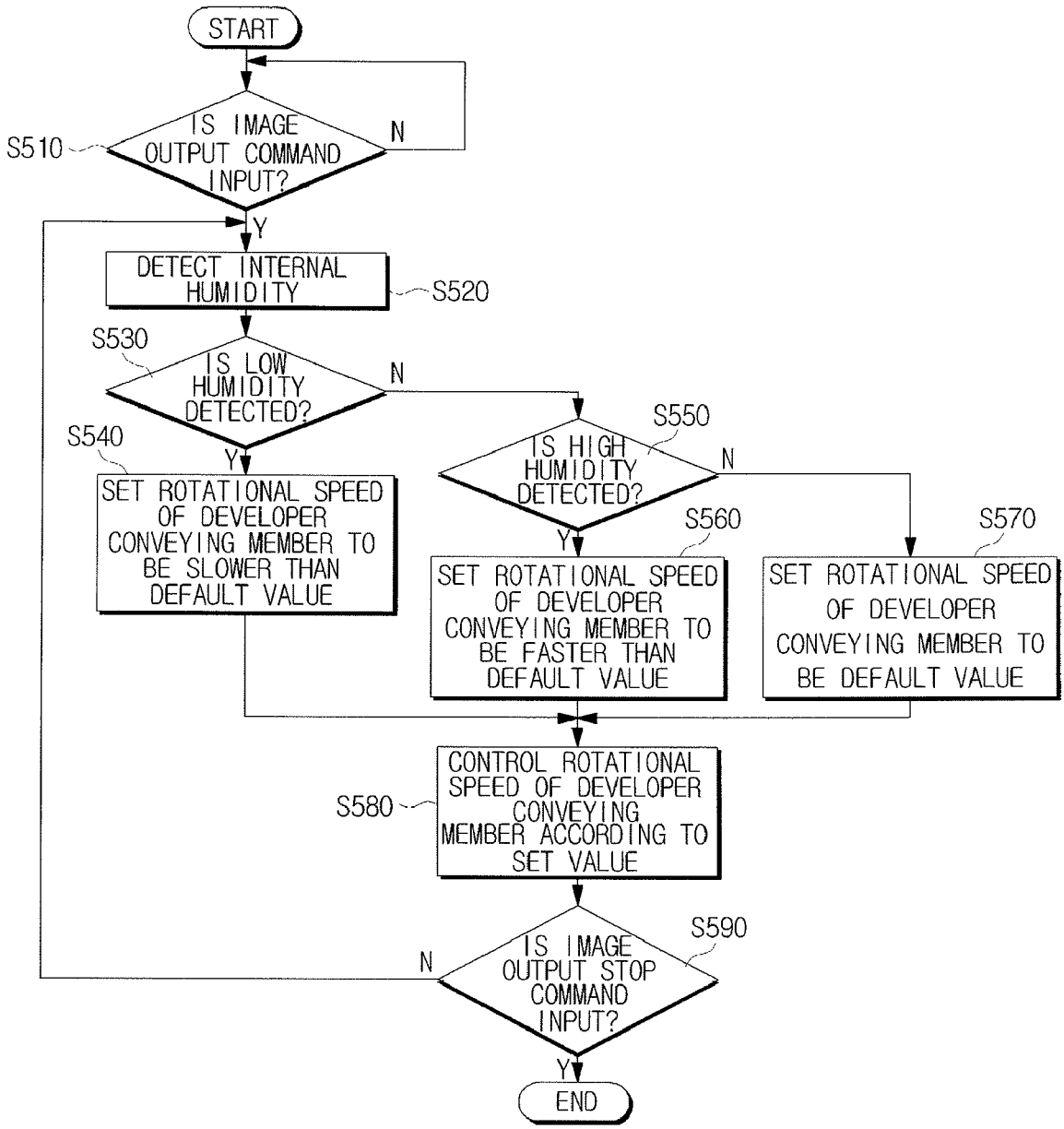

FIGS. 4 and 5 are flowcharts illustrating a method of supplying developer according to another exemplary embodiment of the present general inventive concept. The method embodiment of FIGS. 4-5 will be described using the embodiment of FIG. 1, however, the method embodiment of FIGS. 4-5 or the present general inventive concept is not intended to be limited thereby. As illustrated in FIG. 4, when the developer supplying apparatus 100 receives an image output command at operation S410, the developer supplying apparatus 100 can then detect internal temperature using the first sensing member 110. When the developer supplying apparatus 100 receives a command that is not the image output command at operation S410, the developer supplying apparatus 100 can wait for the next input command (e.g., control jumps back to operation S410).

If the first sensing member 110 detects low temperature at operation S430:Y, the developer supplying apparatus preferably sets rotational speed of the developer conveying member 140 to be slower than a default value at operation S440. For example, if the first sensing member 110 detects 15° C., and if it is below a first threshold (e.g., low temperature threshold set to 17° C.), the first sensing member 110 detects it to be low temperature. If a default rotational speed is set to 280 rpm, the developer conveying member 140 may be controlled to have rotational speed at about 260 rpm according to the result of detection. Alternatively, the developer conveying member 140 may be controlled to one of a plurality of speeds below the default rotational speed according to the actual detected environmental status such as temperature below the first threshold such as the first threshold temperature. For example, if the first sensing member 110 detects a temperature less than 15° C., the developer conveying member 140 may be controlled to have a rotational speed slower than 260 rpm. In another embodiment, the first threshold may include a plurality of sub-thresholds each corresponding to a rotational speed below the default rotational speed.

If the first sensing member 110 detects high temperature at operation S450:Y, the developer supplying apparatus 100 preferably sets rotational speed of the developer conveying member 140 to be faster than a default value at operation S460. For example, if the first sensing member 110 detects 33° C., and if it exceeds a second threshold temperature 30° C., the first sensing member 110 detects it to be high temperature. If default rotational speed is set to 280 rpm, the developer conveying member 140 can be set to about 310 rpm according to the result of detection. Alternatively, in one embodiment, if the first sensing member 110 detects temperature exceeding 33° C., the developer conveying member 140 can be set to be faster than 310 rpm. In another embodiment, the second threshold may include a plurality of sub-thresholds above the second threshold each corresponding to a rotational speed above the default rotational speed.

If the first sensing member 110 detects neither a high temperature nor a low temperature at operation S450:N, the developer supplying apparatus 100 preferably sets rotational speed of the developer conveying member 140 to a default value at operation S470. For example, if default rotational speed is set to 280 rpm, the developer supplying apparatus 100 sets rotational speed to 280 rpm.

When rotational speed of the developer conveying member 140 is set according to internal temperature of the developer supplying apparatus 100 at one of operations S440, S460 and S470, rotational speed of the developer conveying member 140 is controlled according to the set value at operation S480. As illustrated in FIG. 4, the amount of developer, and in particular, toner density can be evenly and/or stably maintained regardless of a variation in developer fluidity caused by environmental conditions such as by temperature.

If an image output stop command is input at operation S490, the developer supplying apparatus 100 stops controlling rotational speed of the developer conveying member 140. When the image output stop command is not received at operation S490, repetition of the S420-S480 operations may be performed.

As illustrated in FIG. 5, the developer supplying apparatus 100 preferably waits to receive an image output command at operation S510, and detects internal humidity using the first sensing member 120 at operation S520 after the image output command is received at operation S510.

If the first sensing member 110 detects low humidity at operation S530:Y, the developer supplying apparatus 100 sets rotational speed of the developer conveying member 140 to be slower than a default value at operation S540. For example, if the first sensing member 110 detects 40% humidity, and if it is below a first threshold humidity of 45%, the first sensing member 110 detects the 40% humidity to be low humidity. If a default rotational speed is set to 280 rpm, rotational speed of the developer conveying member 140 may be set to about 250 rpm according to the result of humidity detection. Alternatively, in one embodiment, if the first sensing member 110 detects less than 40% of humidity, the rotational speed of the developer conveying member 140 may be set to be slower than 250 rpm.

If the first sensing member 110 detects high humidity at operation S550:Y, the developer supplying apparatus 100 sets rotational speed of the developer conveying member 140 to be faster than a default value at operation S460. For example, if the first sensing member 140 detects 70% of humidity, and if it exceeds a second threshold humidity of 65%, the first sensing member 140 detects the 70% humidity to be high humidity. If a default rotational speed is set to 280 rpm, the developer conveying member 140 may be set to have rotational speed of about 310 rpm. Alternatively, in one embodiment, if the first sensing member 110 detects humidity exceeding 70%, rotational speed of the developer conveying member 140 may be set to be faster than 310 rpm.

If the first sensing member 110 detects nether a high humidity nor a low humidity, for example, if the first sensing member 110 detects a normal or medium humidity at operation S550:N, the developer supplying apparatus 100 sets rotational speed of the developer conveying member 140 to a default value at operation S570. For example, if a default rotational speed is set to 280 rpm, the developer conveying member 140 rotational speed is set to 280 rpm.

If the rotational speed of the developer conveying member 140 is set according to internal humidity of the developer supplying apparatus 100 at one of operations S540, S560 and S570, the rotational speed of the developer conveying member 140 is controlled according to the set value at operation S580. Accordingly, the amount of developer, and in particular, the toner density can be evenly or stably maintained regardless of a variation in developer fluidity caused by environmental conditions such as humidity.

If an image output stop command is input at operation S590, the developer supplying apparatus 100 stops controlling of rotational speed of the developer conveying member 140. When the image output stop command is not received at operation S590, repetition of the S520-S580 operations may be performed.

Although embodiments illustrated in FIGS. 4 and 5 illustrate that the rotational speed of the developer conveying member 140 is controlled according to temperature or humidity, alternatively, it is possible that the rotational speed of the developer conveying member 140 is controlled according to both temperature and humidity. Alternatively, the rotational speed of the developer conveying member 140 can be controlled according to other types of environmental status, such as altitude or pressure, individually or in combination with other types of environmental status.

Figure 6:
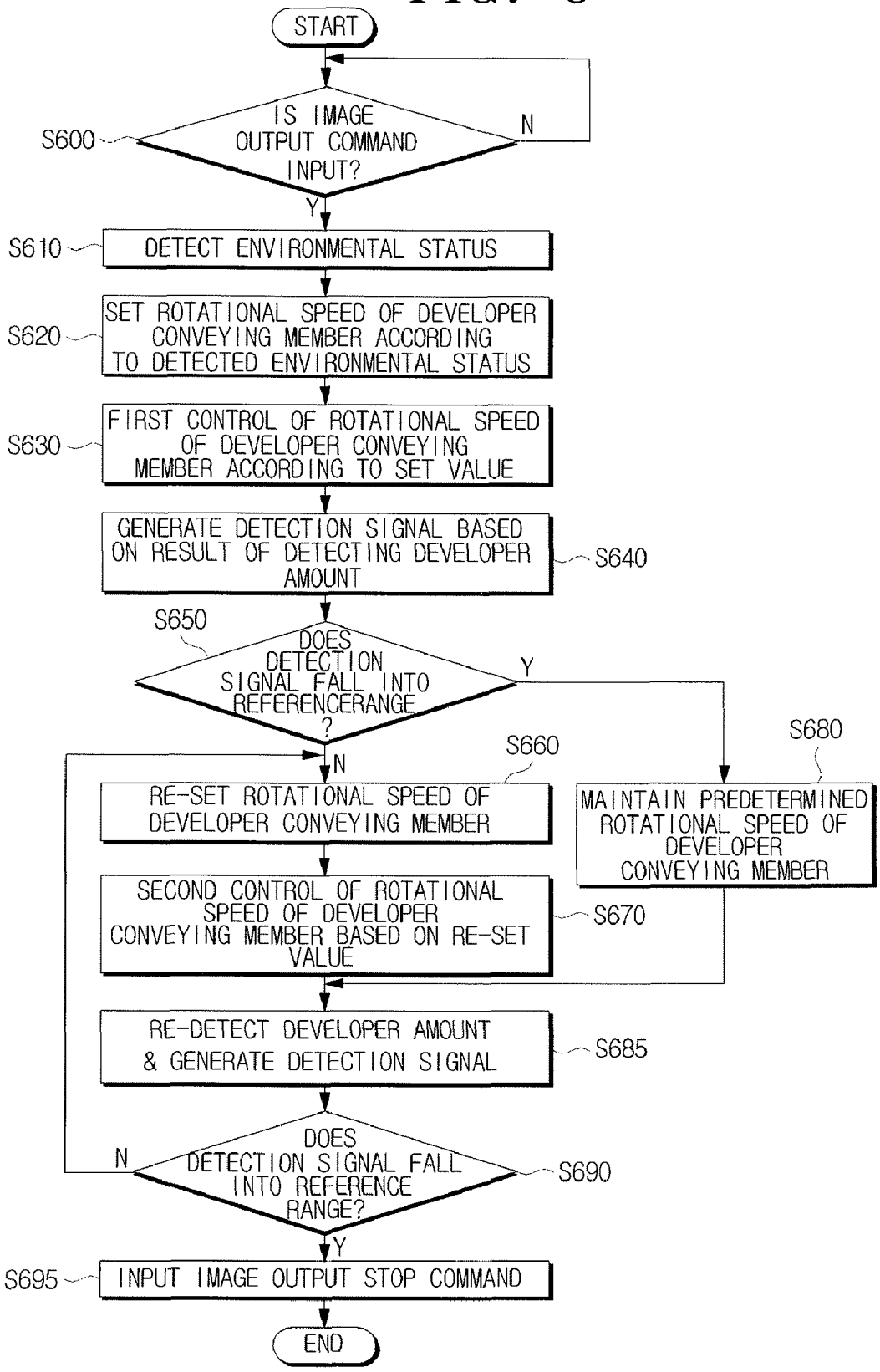
FIG. 6 is a flowchart illustrating a method for supplying developer according to yet another exemplary embodiment of the present general inventive concept.

FIG. 6 is a flowchart illustrating a method of supplying developer according to another exemplary embodiment of the present general inventive concept. The method embodiment of FIG. 6 will be described using the embodiment of FIG. 2, however, the method embodiment of FIG. 6 or the present general inventive concept is not intended to be limited thereby.

As illustrated in FIG. 6, the developer supplying apparatus 200 preferably waits to receive an image output command at operation S600, and detects environmental status (e.g., using the first sensing member 210) at operation S610 after the image output command is received at operation S610.

The developer supplying apparatus 200 then sets rotational speed of the developer conveying member 240 according to the result of detection at operation S620, and primarily controls rotational speed of the developer conveying member 240 at operation S630. Exemplary embodiments that operate to detect/determine the environmental status, set rotational speed and/or control the rotational speed are already explained above at least with reference to FIGS. 4 and 5. Accordingly, a detailed description of such operations will be omitted here.

At operation S640, the developer supplying apparatus 200 may detect the amount of developer using a sensor (e.g., the second sensing member 250), and generate a detection signal according to the detection result. If the second sensing member 250 detects that the amount of developer is lacking, the second sensing member 250 determines that carrier is less and toner is more than necessary and reduce (e.g., continuously) the detection signal of toner supply. If a considerable amount of toner is consumed for special purpose such as high density image printing, the second sensing member 250 may correspondingly increase the size of the detection signal of toner supply.

The developer supplying apparatus 200 preferably determines whether the detection signal generated by the second sensing member 250 falls into the reference range at operation S650, and if not, re-sets rotational speed of the developer conveying member 240 at operation S660. The reference range may be set to be narrower than the second sensing member 250 can possibly generate according to the amount of developer. For example, if the second sensing member 250 can possibly generate reference range of 0 to 4V according to the amount of developer, the reference range may be set to 0.6 to 3.4V. However, the present general inventive concept is not intended to be limited by such an exemplary disclosure. The developer supplying apparatus 200 determines whether the detection signal generated by the second sensing member 250 falls into the reference range (e.g., 0.6-3.4V). For example, the second sensing member 250 may generate detection signal of 0.5V or less, or of 3.4V or more, and then, the developer supplying apparatus 200 re-sets rotational speed of the developer conveying member 240. If the detection signal is 0.5V, the rotational speed of the developer conveying member 240 is set to be slower than a predetermined rotational speed. For example, if the predetermined rotational speed is 310 rpm, the developer conveying member 240 may be set to about 300 rpm. If the detection signal is 3.5V, the rotational speed of the developer conveying member 240 is set to be faster than a predetermined rotational speed. For example, if the predetermined rotational speed is 310 rpm, the developer conveying member 240 can be set to about 320 rpm. If the detection signal generated by the second sensing member 250 falls into range of 0.6 to 3.4V, the developer conveying member 240 can be set to the current or predetermined rotational speed.

The developer supplying apparatus 200 preferably secondarily controls the rotational speed of the developer conveying member 240 according to the re-set value at operation S670. By controlling the rotational speed of the developer conveying member 240 according to the detection signal, which is generated based on the detected amount of developer, the amount of developer can be adjusted. The stage (e.g., second stage) of controlling the rotational speed of the developer conveying member 240 may be repeatedly performed or temporarily performed. For example, the rotational speed re-set at operation S660 may be maintained for several dozens of seconds, and changed back to the predetermined rotational speed. Further, for example, the time to maintain the re-set rotational speed may be set at an initial stage, differentially set according to the size of the detection signal or the like.

The developer supplying apparatus 200 at operation S650 may determine whether the detection signal generated by the second sensing member 250 falls into the reference range. If so, the developer conveying member 240 maintains the current rotational speed at operation S680.

The developer supplying apparatus 200 may control rotational speed at operation S670 and generate a detection signal by re-detecting the amount of developer at operation S685.

The developer supplying apparatus 200 determines whether or not the generated detection signal (e.g., operation S685) falls into the reference range at operation S690, and if not, operations S660, S670 and S685 may be repeatedly performed. If the generated detection signal falls into the reference range at operation S690, the developer supplying apparatus 200 maintains rotational speed of the developer conveying member 240 and outputs image.

The developer supplying apparatus 200 ends the controlling of rotational speed of the developer conveying member 240 upon receiving an image output stop command at operation S695. According to the embodiments of methods described above, fluidity of developer is adjusted in the first stage according to temperature or humidity (e,g., environment), and in the second stage according to the amount of developer. As a result, supply of developer can be maintained in a stable amount.

As described above, according to the present general inventive concept, output speed or rotational speed of the developer conveying member is controlled according to the environmental status to adjust to the developer fluidity fluctuation. As a result, supply of developer can be maintained in a stable amount.

Further, by adjusting rotational speed of the developer conveying member faster or slower according to the detection signal that is generated based on the amount of developer, the developer can be supplied in a stable amount. As a result, image quality deterioration such as caused by lack of toner supply, overflow due to excessive toner supply or the like can be reduced or prevented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Furthermore, for ease of understanding, certain method procedures may have been delineated as separate procedures; however, these separately delineated procedures should not be construed as necessarily order dependent in their performance. That is, some procedures may be able to be performed in an alternative ordering, simultaneously, etc.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transitional terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. A developer supplying apparatus containing developer, comprising:

a developer conveying member to convey a developer along a developer conveyance path by rotational movement;

a first sensing member disposed along the conveyance path to detect an environmental status within the developer supplying apparatus and an amount of developer;

a first setting unit to set a rotational speed of the developer conveying member according to the detected environmental status; and a control unit to perform a first control of rotational speed of the developer conveying member according to the rotational speed set by the first setting unit.

2. The developer supplying apparatus of claim 1, wherein the environmental status comprises an internal temperature of the developer supplying apparatus, and the first setting unit sets the rotational speed of the developer conveying member to a default value if the temperature detected by the first sensing member falls into a range between a first threshold temperature and a second threshold temperature.

3. The developer supplying apparatus of claim 2, wherein the first setting unit sets the rotational speed of the developer conveying member to be slower than the default value if the first sensing member detects the temperature below the first threshold temperature, and sets the rotational speed of the developer conveying member to be faster than the default value if the first sensing member detects the temperature exceeding the second threshold temperature.

4. The developer supplying apparatus of claim 1, wherein the environmental status comprises internal humidity of the developer supplying apparatus, and the first setting unit sets rotational speed of the developer conveying member to a default value, if the first sensing member detects the humidity that falls into a range between a first threshold humidity and a second threshold humidity.

5. The developer supplying apparatus of claim 4, wherein the first setting unit sets the rotational speed of the developer conveying member to be slower than the default value if the first sensing member detects the humidity below the first threshold humidity, and sets the rotational speed of the developer conveying member to be faster than the default value if the first sensing member detects the humidity exceeding the second threshold humidity.

6. The developer supplying apparatus of claim 1, wherein the environmental status comprises categories of low temperature and low humidity, normal status, and high temperature and high humidity according to internal temperature and humidity of the developer supplying apparatus, and the first setting unit sets rotational speed of the developer conveying member to be slower than the default value if the first sensing member detects the environmental status to be the low temperature and low humidity, sets the rotational speed of the developer conveying member to the default value if the first sensing member detects the environmental status to be the normal status, and sets the rotational speed of the developer conveying member to be faster than the default value if the first sensing member detects the environmental status to be the high temperature and high humidity.

7. The developer supplying apparatus of claim 1, further comprising:

a second sensing member to detect the amount of developer and generate a detection signal; and a second setting unit to set the rotational speed of the developer conveying member by comparing the detection signal of the second sensing member with a reference range, wherein the control unit performs a second control of the rotational speed of the developer conveying member according to the rotational speed set by the second setting unit.

8. The developer supplying apparatus of claim 7, wherein the second setting unit maintains the rotational speed set by the first setting unit or a predetermined rotational speed if the detection signal falls into the reference range.

9. The developer supplying apparatus of claim 7, wherein the second setting unit sets the rotational speed of the developer conveying member to be slower than a predetermined rotational speed if the detection signal is below a lower boundary of the reference range, and sets the rotational speed of the developer conveying member to be faster than the predetermined rotational speed if the detection signal exceeds an upper boundary of the reference range.

10. The developer supplying apparatus of claim 7, wherein when the second control of the rotational speed of the developer conveying member is performed, the control unit controls the second sensing member and the second setting unit to re-detect the amount of developer and to re-set the rotational speed according to the result of the re-detection, and re-controls the rotational speed of the developer conveying member to the re-set rotational speed.

11. The developer supplying apparatus of claim 1, wherein the developer comprises bi-component developer including toner and carrier.

12. A method of supplying developer contained in a developer supply apparatus, comprising:

detecting an environmental status along a developer conveyance path within the developer supplying apparatus;

setting rotational speed of a developer conveying member according to the detected environmental status; and performing a first control of rotational speed of the developer conveying member according to the set rotational speed.

13. The method of claim 12, wherein the environmental status comprises an internal temperature of the developer supplying apparatus, and the setting comprises setting the rotational speed of the developer conveying member to a default value if the detected temperature falls into a range between a first threshold temperature and a second threshold temperature.

14. The method of claim 13, wherein the setting comprises setting the rotational speed of the developer conveying member to be slower than the default value if the detected temperature is below the first threshold temperature, and setting the rotational speed of the developer conveying member to be faster than the default value if the detected temperature exceeds the second threshold temperature.

15. The method of claim 12, wherein the environmental status comprises internal humidity of the developer supplying apparatus, and the setting comprises setting the rotational speed of the developer conveying member to a default value if the detected humidity falls into a range between a first threshold humidity and a second threshold humidity.

16. The method of claim 15, wherein the setting comprises setting the rotational speed of the developer conveying member to be slower than the default value if the detected humidity is below the first threshold humidity, and setting the rotational speed of the developer conveying member to be faster than the default value if the detected humidity exceeds the second threshold humidity.

17. The method of claim 16, wherein when the second control of the rotational speed of the developer conveying member is performed, the method comprises:

re-detecting the amount of developer;

re-setting the rotational speed according to a result of the re-detection; and controlling the rotational speed of the developer conveying member to the re-set rotational speed.

18. The method of claim 12, wherein the environmental status comprises categories of low temperature and low humidity, normal status, and high temperature and high humidity according to internal temperature and humidity of the developer supplying apparatus, and wherein the setting comprises setting the rotational speed of the developer conveying member to be slower than the default value if the detected environmental status is the low temperature and low humidity, setting the rotational speed of the developer conveying member to the default value if the detected environmental status is the normal status, and setting the rotational speed of the developer conveying member to be faster than the default value if the detected environmental status is the high temperature and high humidity.

19. The method of claim 12, further comprising:

detecting the amount of developer and generating a detection signal;

setting rotational speed of the developer conveying member by comparing the detection signal with a reference range; and performing a second control of the rotational speed of the developer conveying member according to the set rotational speed.

20. The method of claim 19, wherein the setting rotational speed of the developer conveying member by comparing the detection signal with the reference range comprises maintaining a predetermined rotational speed if the detection signal falls into the reference range.

21. The method of claim 19, wherein the setting rotational speed of the developer conveying member by comparing the detection signal with the reference range comprises setting the rotational speed of the developer conveying member to be slower than the predetermined rotational speed if the detection signal is below a lower boundary of the reference range, and setting the rotational speed of the developer conveying member to be faster than the predetermined rotational speed if the detection signal exceeds an upper boundary of the reference range.

22. A developer supplying apparatus containing a developer, comprising:

a developing conveying member to convey the developer along a conveyance path by rotational movement;

a first sensing member disposed along the conveyance path to detect an environmental status within the developer supplying apparatus and an amount of developer, wherein, the rotational movement of the developing conveying member is varied to adjust an amount of the developer according to the detected environmental status surrounding the developer within the developer supplying apparatus.

23. An image forming apparatus, comprising:

a printing unit to form an image on a printing medium, and a developer supplying apparatus to communicate with the printing unit, and having a developing conveying member to convey a developer contained in the developer supplying apparatus along a conveyance path by rotational movement; and a first sensing member disposed along the conveyance path to detect an environmental status within the developer supplying apparatus and an amount of developer, wherein the developer supplying apparatus adjusts the rotational movement to adjust an amount of the developer according to the detected environmental status surrounding the developer within the developer supplying apparatus.

24. A developer supplying apparatus containing developer comprising:

a developer conveying member to convey the developer along a developer conveyance path by rotational movement;

a first sensing member disposed along the conveyance path to detect an environmental status within the developer supplying apparatus and an amount of developer; and a control module to adjust a rotational speed of the developer conveying member according to the detected environmental status within the developer supplying apparatus and the detected amount of developer.

25. The developing supplying apparatus of claim 24, wherein the environmental status is at least one of an internal temperature within the developing supply apparatus and an internal humidity within the developer supplying apparatus.

* * * * *